US010464732B2

(12) United States Patent
Krupa et al.

(10) Patent No.: US 10,464,732 B2
(45) Date of Patent: Nov. 5, 2019

(54) AIR TIGHT GAS CIRCULATING CONTAINER

(71) Applicant: UPAC2, Greenfield, MN (US)

(72) Inventors: Calvin S. Krupa, Greenfield, MN (US); Michael Jacobs, Coon Rapids, MN (US)

(73) Assignee: UPAC2, Greenfield, MN (US)

( * ) Notice: Subject to any disclaimer, the term of this patent is extended or adjusted under 35 U.S.C. 154(b) by 103 days.

(21) Appl. No.: 15/672,033

(22) Filed: Aug. 8, 2017

(65) Prior Publication Data

US 2019/0047768 A1 Feb. 14, 2019

(51) Int. Cl.

| | |
|---|---|
| ***B65D 81/00*** | (2006.01) |
| ***B65D 81/20*** | (2006.01) |
| ***B65D 1/36*** | (2006.01) |
| ***B65D 1/44*** | (2006.01) |
| ***B65D 77/20*** | (2006.01) |
| ***B65D 21/02*** | (2006.01) |
| ***B65D 81/26*** | (2006.01) |
| ***B65D 81/28*** | (2006.01) |
| ***B65D 43/02*** | (2006.01) |
| ***B65D 51/28*** | (2006.01) |
| ***B65D 51/30*** | (2006.01) |

(52) U.S. Cl.

CPC ..... *B65D 81/2076* (2013.01); *B65D 1/36* (2013.01); *B65D 1/44* (2013.01); *B65D 21/0223* (2013.01); *B65D 43/0208* (2013.01); *B65D 51/28* (2013.01); *B65D 51/30* (2013.01); *B65D 77/2016* (2013.01); *B65D 81/266* (2013.01); *B65D 81/28* (2013.01); *B65D 2543/00027* (2013.01); *B65D 2543/00101* (2013.01); *B65D 2543/00296* (2013.01); *B65D 2543/00555* (2013.01); *B65D 2543/00657* (2013.01); *B65D 2543/00685* (2013.01); *B65D 2543/00768* (2013.01); *B65D 2543/00796* (2013.01)

(58) Field of Classification Search

CPC ..... B65D 21/0223; B65D 81/2076; B65D 81/266; B65D 81/28; B65D 43/0208; B65D 51/28; B65D 77/2016; B65D 2543/00657; B65D 2543/00296; B65D 2543/00768; B65D 2543/00685; B65D 2543/00101; B65D 2543/00796

USPC ..... 206/213.1

See application file for complete search history.

(56) References Cited

U.S. PATENT DOCUMENTS 3,107,027 A * 10/1963 Sheng-Chiao ..... B65D 1/36 206/546
3,124,241 A * 3/1964 Holley et al. ..... B65D 73/0092 206/461
3,240,610 A * 3/1966 Cease ..... A47G 23/0683 126/390.1
3,310,334 A * 3/1967 Murphy ..... B65D 71/406 206/145
4,178,955 A * 12/1979 Dau ..... B60K 15/077 137/264

(Continued)

*Primary Examiner* — Ernesto A Grano
(74) *Attorney, Agent, or Firm* — Dewitt LLP; Thomas J. Nikolai

(57) ABSTRACT

Inhibiting spoilage of items is achieved by providing a container having an environmentally controlled storage compartment sealed form the external atmosphere and a reaction medium in a separate compartment in fluid communication with the storage compartment.

20 Claims, 12 Drawing Sheets

(56) References Cited

U.S. PATENT DOCUMENTS 4,314,650 A * 2/1982 Cillario ..... B65D 71/00 206/526
4,328,254 A * 5/1982 Waldburger ..... B65D 81/343 206/558
4,694,961 A * 9/1987 Menendez ..... A21B 3/132 206/508
4,854,465 A * 8/1989 Reilly ..... B65D 1/22 220/23.4
6,119,862 A * 9/2000 Childress ..... B65D 1/36 206/557
6,447,825 B1 * 9/2002 Korsten ..... B65D 81/3453 426/106
6,880,748 B2 4/2005 Machado et al.
7,083,818 B2 * 8/2006 Pratte ..... B65D 25/06 426/115
D610,903 S * 3/2010 Shapiro ..... B65D 1/34 D9/428
7,748,560 B2 * 7/2010 DaCosta ..... B65D 81/2076 220/367.1
7,748,561 B2 * 7/2010 Varriano-Marston ..... B65D 81/2076 206/541
D635,816 S * 4/2011 France ..... D7/354
D635,817 S * 4/2011 France ..... D7/354
D636,218 S * 4/2011 France ..... D7/354
D638,701 S * 5/2011 Shapiro ..... D9/428
D639,186 S * 6/2011 Shapiro ..... D9/711
D639,656 S * 6/2011 Shapiro ..... D9/435
D653,495 S * 2/2012 France ..... D7/354
8,302,528 B2 * 11/2012 Pawlick ..... B65D 81/343 99/448
D680,426 S * 4/2013 Baker ..... D9/431
8,613,249 B2 * 12/2013 France ..... A23L 5/13 220/23.87
8,850,964 B2 * 10/2014 Pawlick ..... A47J 27/16 220/201
D717,162 S * 11/2014 Baker ..... D9/431
8,887,918 B2 * 11/2014 Parsons ..... B65D 77/046 206/546
9,027,825 B2 * 5/2015 Baker ..... B65D 25/00 206/524.1
9,132,951 B2 * 9/2015 Parsons ..... B65D 77/046
9,211,030 B2 * 12/2015 France ..... A47J 27/16
9,527,648 B2 12/2016 Machado
9,676,539 B2 * 6/2017 Sloat ..... B65D 81/3453

* cited by examiner

AIR TIGHT GAS CIRCULATING CONTAINER

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to packaging. More specifically, the present invention relates to plastic packaging that is resealable, clear and has a controlled internal environment such as to keep food stored therein from spoiling.

II. Discussion of the Prior Art

Microscopic bacteria causes food to spoil. These organisms consume unprotected food and deposit waste. In a wide range of environmental condition, these organisms multiply rapidly hastening food spoilage.

Meats, dairy products, fruits and vegetables are all highly susceptible to spoilage. Since the beginning of time, humans have endeavored to find acceptable ways to preserve food. Various food additives, food processing and preparation techniques, and cold storage systems have been developed. Food additives can cause health concerns and adversely affect the flavor and appearance of the food. Food processing and preparation techniques raise similar concerns and are not suited at all for farm-fresh foods, such as eggs, fresh vegetables and fresh fruit.

Refrigeration is effective for some foods, but freezing some foods renders them unacceptable and refrigeration at temperatures at or just above the freezing point of water is only marginally effective.

Other efforts have been made to produce packaging that seals the food in a confined space so that microbes in the atmosphere do not encounter the food. Some packages have been developed that attempt to alter or control the atmosphere inside of a food container to inhibit bacterial growth and reproduction. Examples of such packages are illustrated and described in U.S. Pat. No. 6,880,748, granted Apr. 19, 2005 to Machado et al and U.S. Pat. No. 9,527,648, granted Dec. 27, 2016 to Machado et al. These patents describe the use of a gaseous agent in combination with a container to make the atmosphere with the container hostile to microbes. The agent can be any number of gases including carbon dioxide, chlorine dioxide, ethylene, nitrogen, sulfa dioxide or the like.

Such packages known in the prior art do not fully meet the needs of food sellers and consumers for a variety of reasons. Many are made of opaque corrugated paper and, thus, interfere with visual food inspection. Others are not rigid and offer very little protection from damaging external crushing forces being applied to the food. Still others have proven to be difficult to stack or transport. Others are prone to come open unintentionally during transport and storage. Still others are easily breached and resealed by persons wishing to tamper with the food such that no readily observable evidence of such tampering is provided by the package. Gases are only effective if they can readily reach all areas of the interior of the food container. The suitable flow of gases throughout the container is often prevented by the contents of the package or blockage of pathways through which the gas is intended to enter the container.

Thus, there continues to exist today a real need for a container that addresses each of these shortcomings found in prior art containers.

SUMMARY OF THE INVENTION

The foregoing problems and others are solved by providing a food container comprising a unique cover and a lid. The housing is made of a single piece of clear plastic material. The lid likewise is made of a single piece of clear plastic material. This makes it easy to inspect the contents of the food container. Adhesive bands or labels can be used to provide easy visual evidence of tampering. Such bands or labels may be placed over the junction of the housing and lid as the food is packaged. A broken band or label will suggest to the observer that the package has been opened and, perhaps, been the subject of tampering. The housing has at least one and often a plurality of storage compartments. In a first embodiment, the housing includes two such storage compartments. In other embodiments, one, or three or more storage compartments are provided.

In the first embodiment, the two storage compartments each have a cavity in which food (or some other item requiring a controlled environment) is stored. The cavity is defined by an imperforate base and four imperforate walls. Each of the four imperforate walls extends upwardly from the base and has a top. More specifically, the four walls comprise a pair of opposing, upstanding side walls, a first end wall and a second end wall. The two storage compartments are arranged so that the first end wall of the first storage compartment and the first end wall of the second storage compartment are adjacent each other.

The first and second storage compartments each may be provided with a plurality of parallel ridges defining a plurality of convex valleys. These are found on the base and on each of the four walls of each of the two storage compartments. Each ridge has an apex. The distance between the apex of each two adjacent ridges of the plurality of ridges is variable, but preferably less than or equal to one-half inch at the widest point. This serves to maintain many types of food stored in the cavities outside of the valleys. Further, the ridges and valleys of the base and two of the opposing walls are aligned to form a plurality of uninterrupted flow channels extending across the base and up said two walls.

The design of the rim of the housing is also significant. The rim has an uninterrupted top surface. The rim includes a peripheral rim portion and a bridge. The bridge extends between the tops of the adjacent end walls of the first and second storage compartments holding them together. The bridge also lends support the peripheral rim portion. The rim portion has an upstanding interior wall with a concave interior face, a convex head extending outwardly (and somewhat upwardly) from the upstanding interior wall, an exterior wall extending downwardly from the convex head and having a concave exterior face, and a flange projecting outwardly from the bottom of the exterior wall. The bridge comprises a pair of bridge walls, each having a concave face facing away from each other and a convex bridge head extending between upper ends of the bridge walls. The uninterrupted top surface of the rim referenced above is defined by the convex head of the peripheral rim portion and the convex bridge head of the bridge.

As noted above, the lid is made of a single piece of clear plastic material. The lid of the first embodiment has a first imperforate plate adapted to cover the first storage compartment of the housing and a second imperforate plate adapted to cover the second storage compartment of the housing. The lid also includes an attachment member comprising a peripheral rim portion engagement section and a bridge engagement section.

The peripheral rim portion engagement section comprises a peripheral channel. This channel is defined by a pair of channel walls joined together by a concave head. The channel walls have convex surfaces facing each other. The peripheral rim portion engagement section is adapted to receive and form an air tight seal with the peripheral rim portion of the housing. This serves to seal the cavities of the first and second storage compartments from the exterior of the housing, i.e., the atmosphere outside the container.

The bridge engagement section of the lid's attachment member joins the first and second plates together and includes a bridge receiving channel. The bridge receiving channel comprises a pair of bridge channel walls joined together by a concave bridge channel head. The bridge channel walls have convex surfaces facing each other. The bridge engagement section is adapted to receive and form an air tight seal with the bridge of the housing, thus sealing the cavities of the first and second storage compartments from each other.

The lid further comprises a first media compartment recessed in and from the first plate, and a second media compartment recessed in and from the second plate. Each such media compartment includes a trough. Each trough includes a platform and an upstanding wall surrounding and extending upwardly from the platform. The platform and upstanding wall of each of the first and second media compartments are adapted to support and contain a payload comprising a medium employed to control the internal environment of a storage compartment of the housing. The payload may, for example, be a gas permeable package containing a gas generating medium. The first media compartment includes at least one gas flow opening adapted to allow gas to flow between the first media compartment and the first storage compartment. Likewise, the second media compartment includes at least one gas flow opening adapted to allow gas to flow between the second media compartment and the second storage compartment.

The gas flow openings are positioned relative to the trough so that a medium (such as a gas source) positioned within the trough does not block the gas flow openings. For example, the media compartments may include a ledge projecting outwardly from the top of the upstanding wall of the trough and a peripheral wall extending upwardly from the opposite edge of the ledge. If gas flow openings are formed in this ledge or the peripheral wall extending upwardly from the ledge, a gas source in the trough typically will not block the gas flow openings.

Various modifications can, of course, be made. For example, a greater number of storage compartments may be included in the base and the lid may be modified accordingly.

A system including not only the container, but also media and covers for the media compartments may be provided. Such covers for the media compartments serve two important functions when the media is a gas source. First, the covers prevent air from the external atmosphere from entering the container through the gas flow openings. Second, the covers prevent gas from the gas source from escaping into the atmosphere. Instead, the gas is driven into the container where it flows throughout the container, including through the channels, killing micro organisms that would otherwise cause spoilage of the food.

BRIEF DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
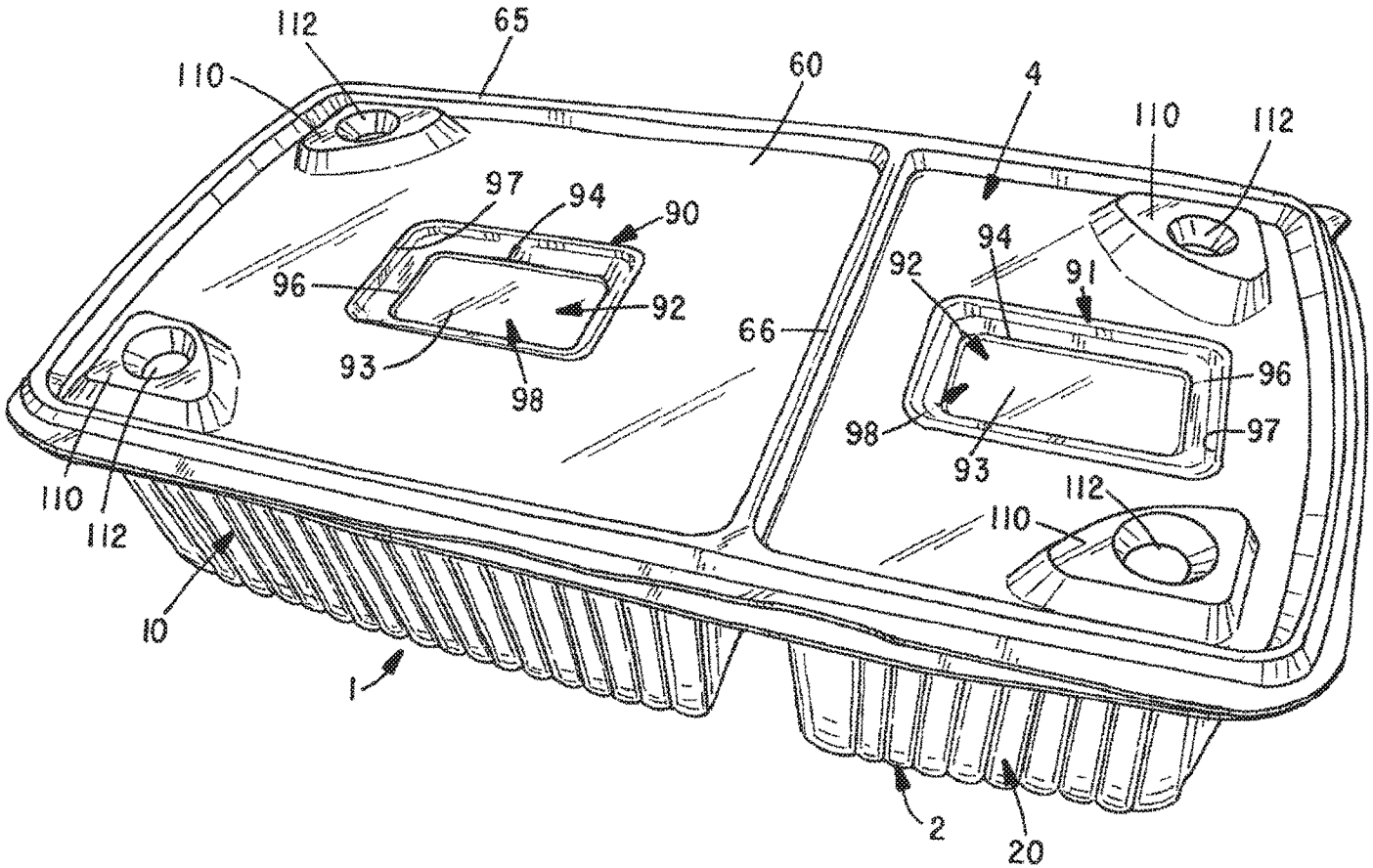
FIG. 1 is a perspective view of a container made in accordance with the present invention.
Figure 2:
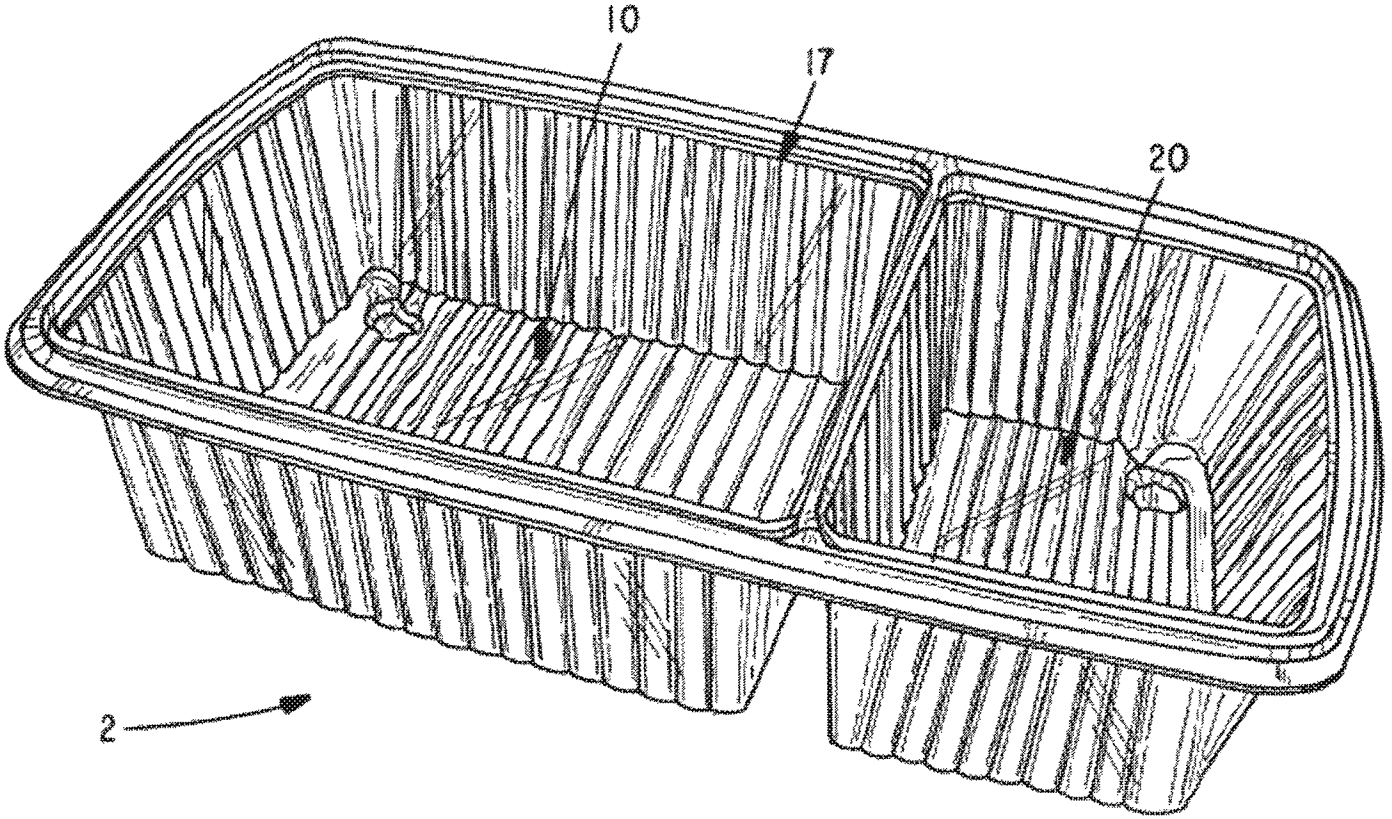
FIG. 2 is a perspective view of the housing of the container of FIG. 1.
Figure 3:
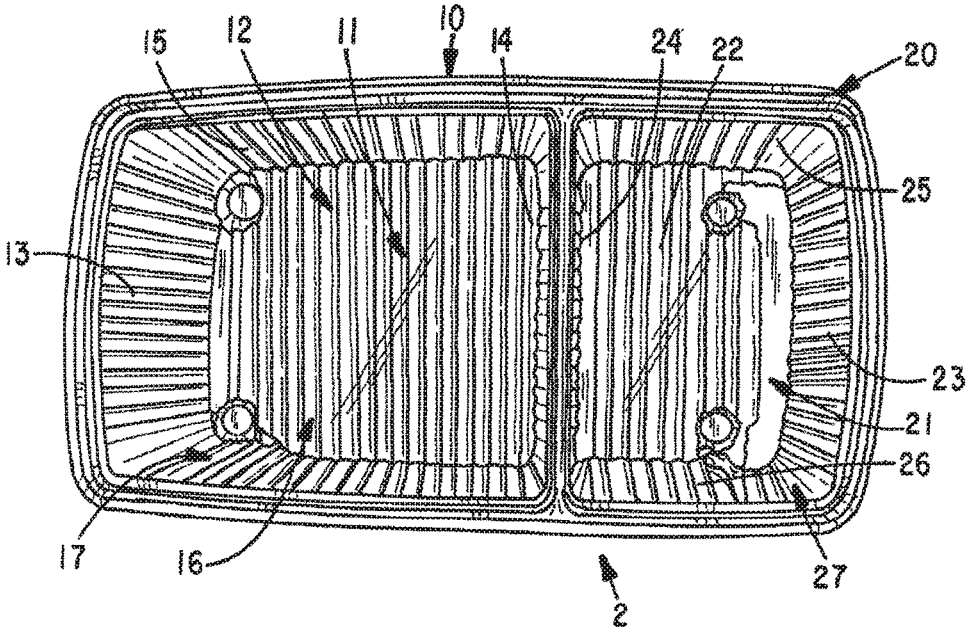
FIG. 3 is a top view of the housing of the container of FIG. 1.
Figure 4:
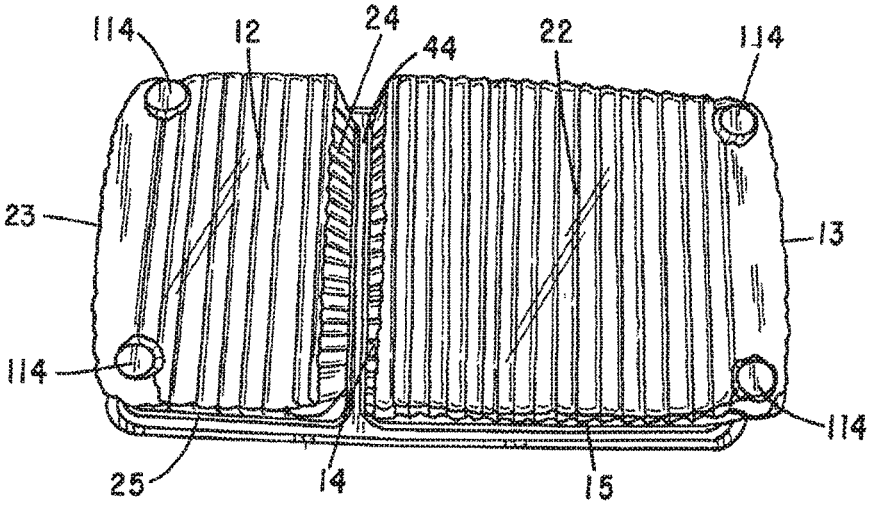
FIG. 4 is a bottom view of the housing of the container of FIG. 1.
Figure 5:
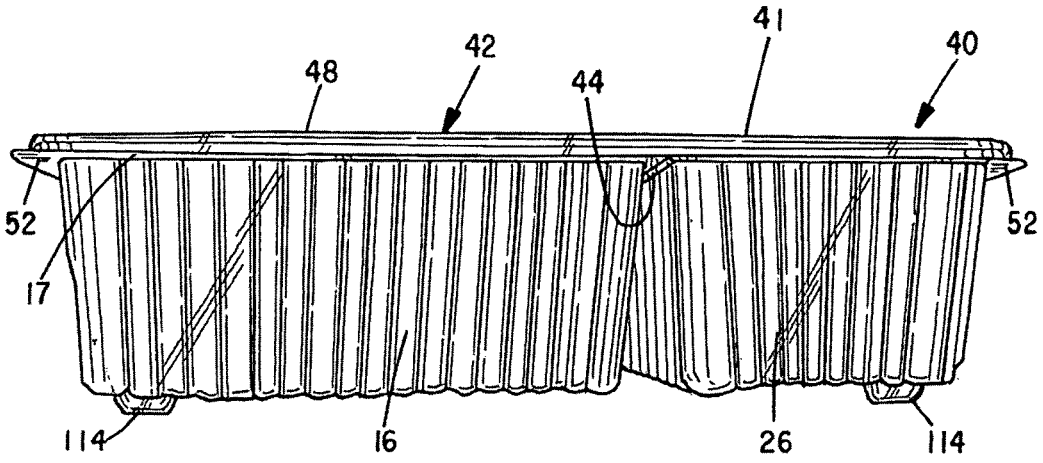
FIG. 5 is a side view of the housing of the container of FIG. 1.
Figure 6:
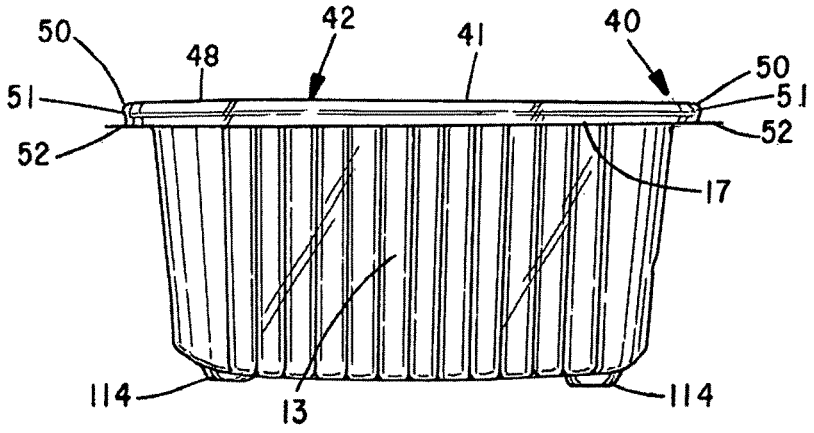
FIG. 6 is an end view of the housing of the container of FIG. 1.
Figure 7:
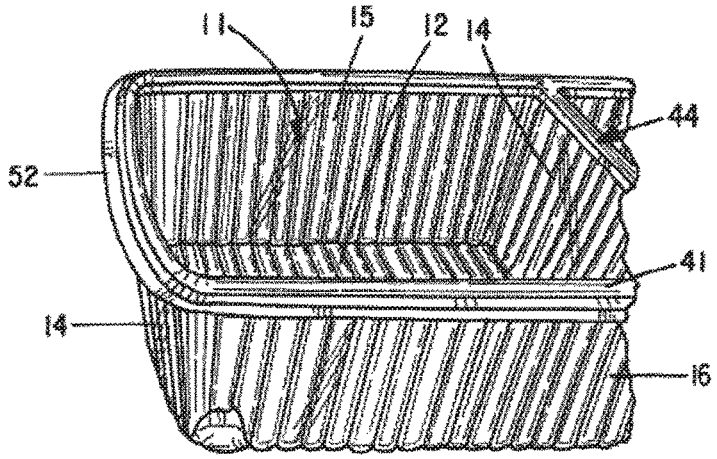
FIG. 7 is a partial perspective view of one of the storage compartments of the container of FIG. 1.
Figure 8:
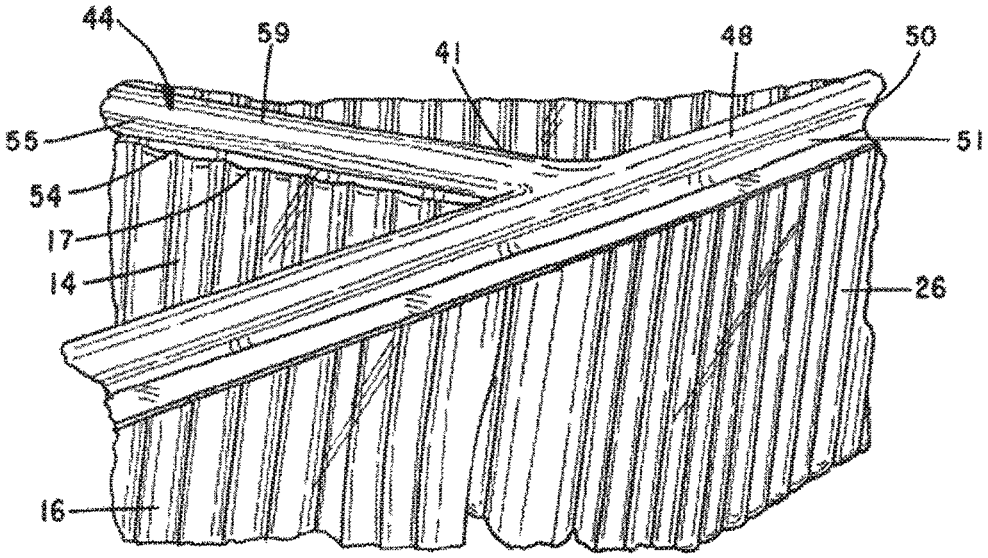
FIGS. 8-10 are each a partial perspective view of the housing of FIG. 1 showing the bridge used to couple together two of the storage compartments of the container of FIG. 1.
Figure 9:
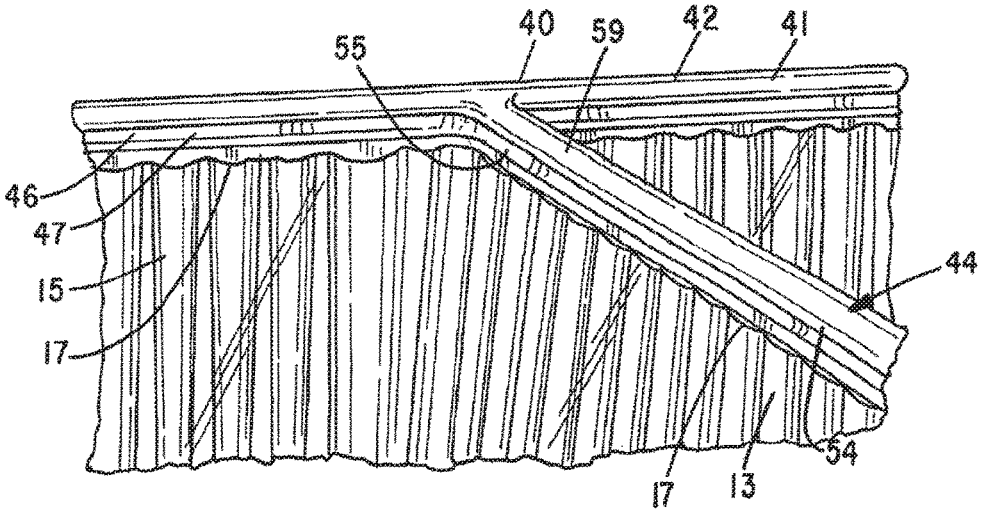
Figure 10:
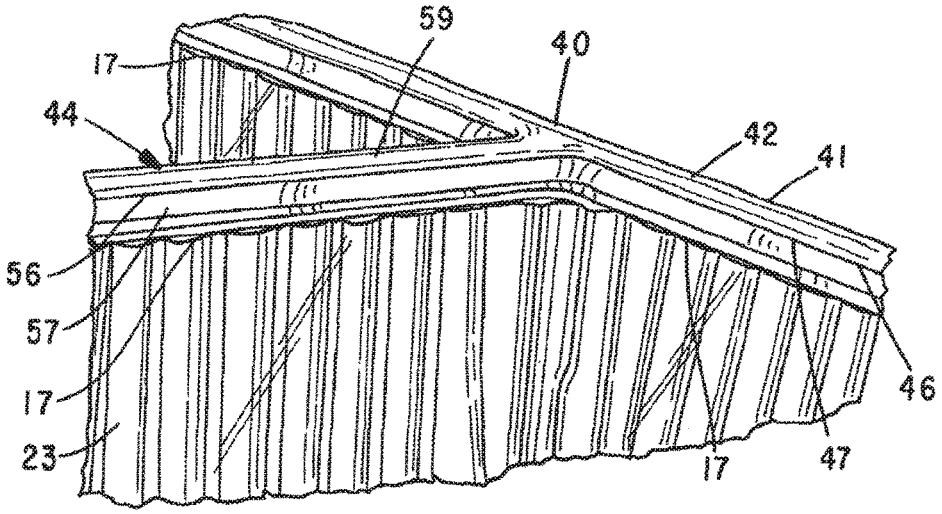
Figure 11:
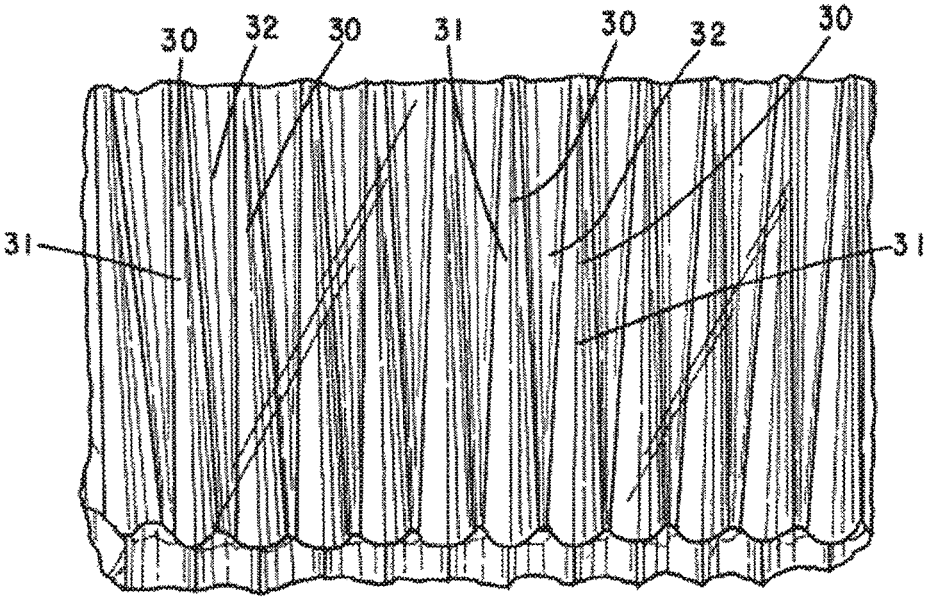
FIGS. 11 and 12 are each partial perspective views showing the ridges and valleys of the storage compartments of the container of FIG. 1.
Figure 12:
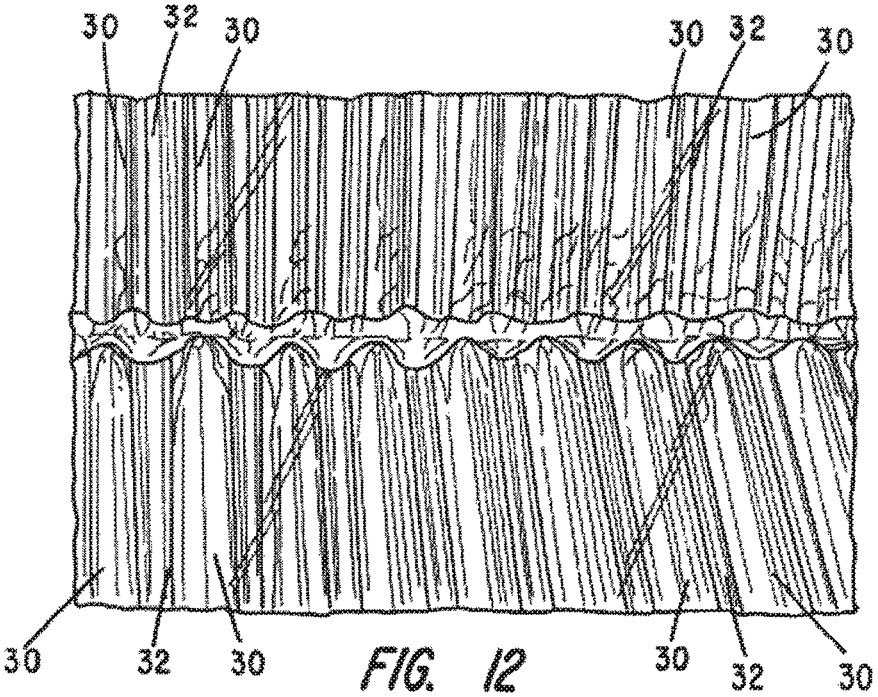
Figure 13:
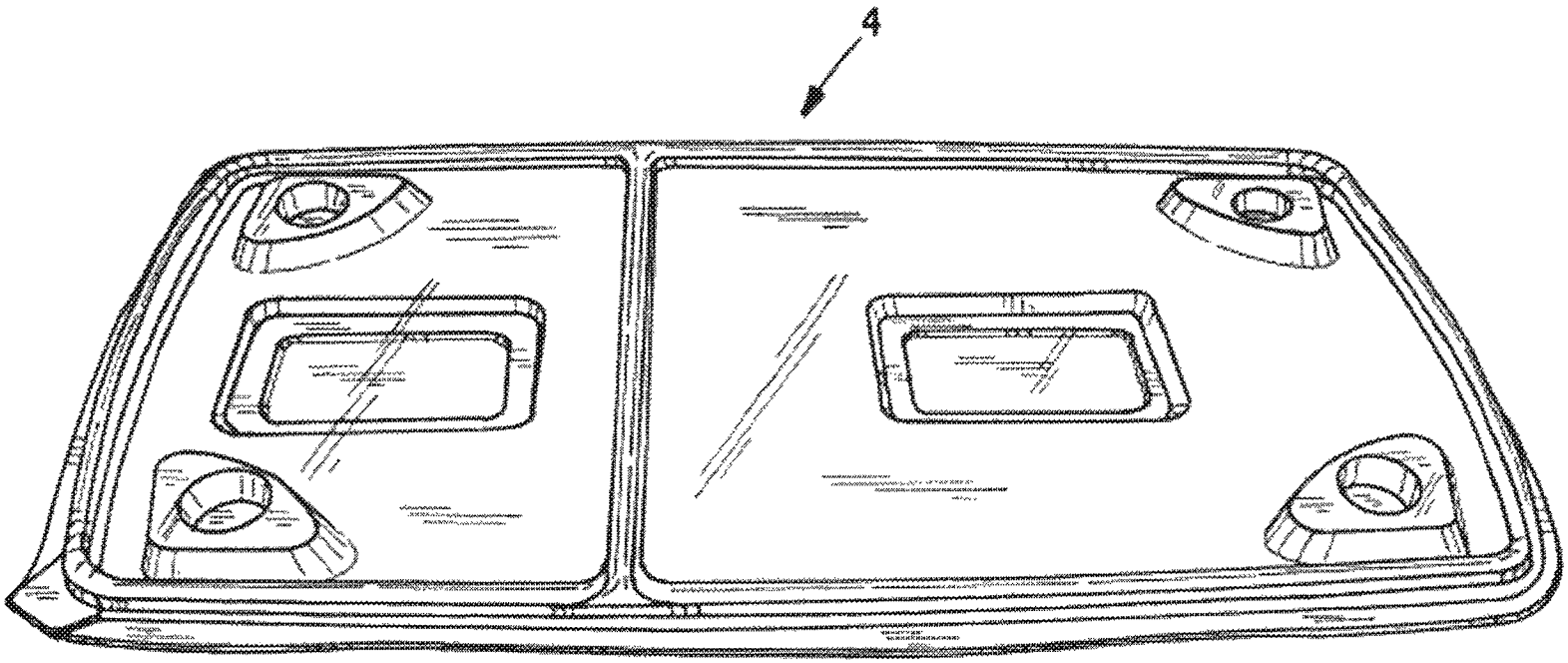
FIG. 13 is a perspective view of the lid of the container shown in FIG. 1.
Figure 14:
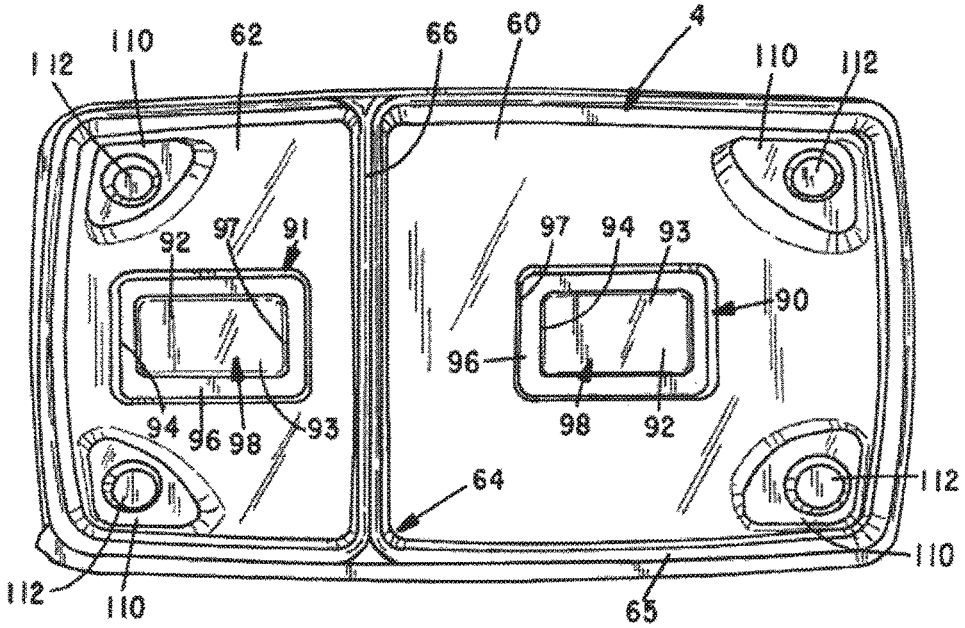
FIG. 14 is a top view of the lid of the food container of FIG. 1.
Figure 15:
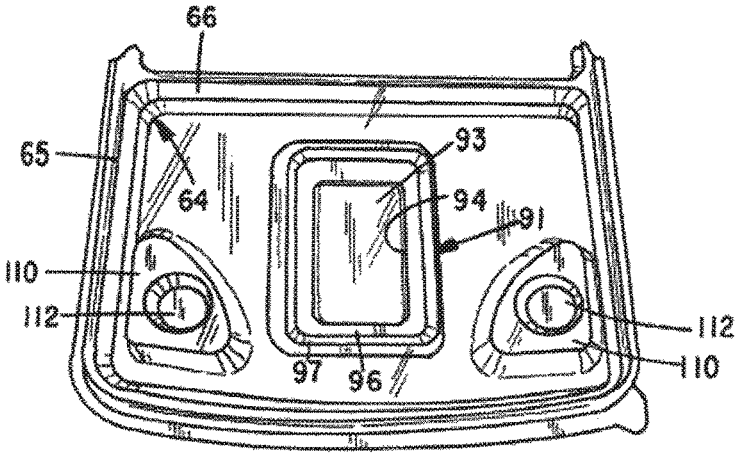
FIG. 15 is a partial perspective view of the lid of the food container of FIG. 1.
Figure 16:
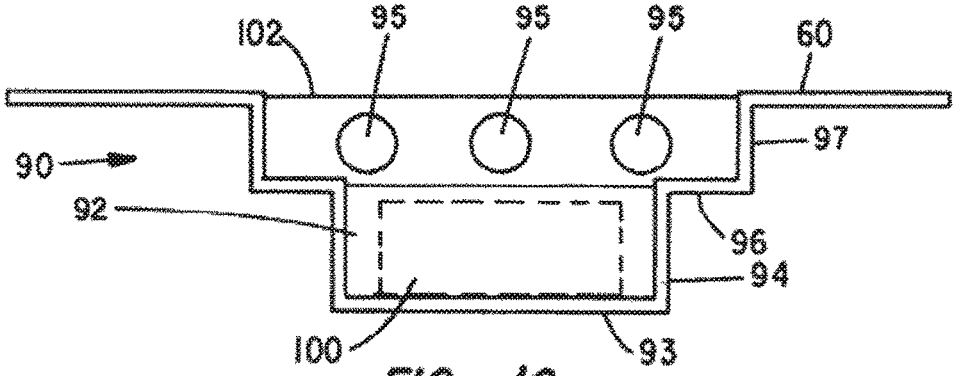
FIG. 16 is a cross-sectional view of one of the media compartments of the lid of FIG. 1.
Figure 17:
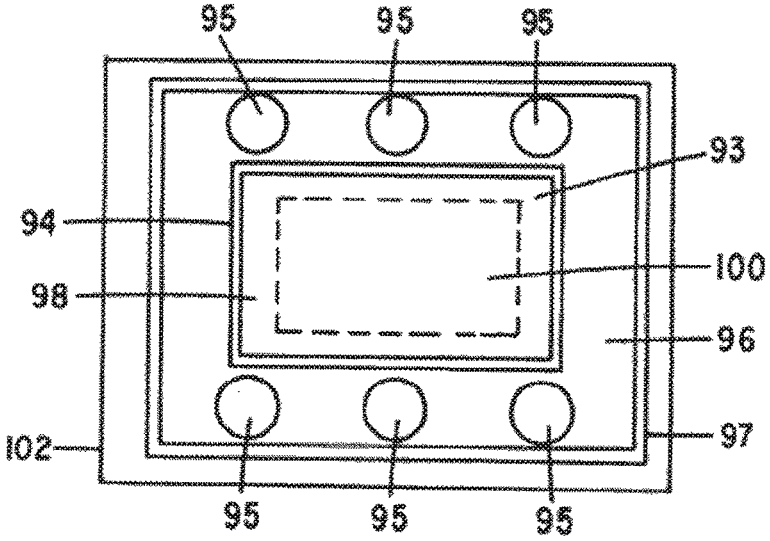
FIG. 17 is a top view of one of the media compartments shown in FIG. 1.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

FIG. 1 shows a container 1 made in accordance with the present invention. The container 1 comprises a housing 2 and a lid 4.

The housing 2 is made of a single piece of a clear plastic polymer material. Likewise, the lid 4 is formed of a clear plastic polymer material. This makes the housing 2 and lid 4 transparent so that the contents of the container 1 are easily inspected visually without opening the container 1. The housing 2 and lid 4 will typically be formed using an injection molding process. However, other techniques to form the housing 2 and lid 4 may be used. An example of a clear plastic polymer material that may be used is polyethylene terephthalate (PET). Of course, other clear plastic polymers may be used without deviating from the invention.

FIGS. 2 through 12 show the housing 2 in greater detail. As shown, the housing 2 has a first storage compartment 10 and a second storage compartment 20. The first storage compartment 10 has a cavity 11 defined by a base 12 and four walls 13, 14, 15 and 16. Each wall extends upwardly from base 12. As shown, walls 13 and 14 are opposing end walls and walls 15 and 16 are opposing side walls. Each wall has a top 17.

Similarly, the second storage compartment 20 has a cavity 21 defined by a base 22, opposing end walls 23 and 24, and opposing side walls 25 and 26. Each of the walls 23-26 extends upwardly from the base 22 and has a top 27.

The base and walls of each storage compartment shown include a plurality of parallel ridges 30, each terminating in an upper apex 31. The apex is essentially a narrow line extending the length of each ridge 30 at its peak. Each pair of adjacent ridges 30 define a concave valley 32. As shown in several of the figures, including FIG. 12, the ridges 30 and valleys 32 of the base are aligned with the ridges 30 and valleys 32 of the side walls 15 and 16 in the case of the first storage compartment and side walls 25 and 26 in the case of the second storage compartment to form continuous, uninterrupted flow channels 34 extending across the base and up the side walls. Of course, the ridges 30 and valleys 32 of the base could alternatively be aligned with the ridges and valleys of the end walls 13, 14 and 23, 24 to form uninterrupted flow channels without deviating from the invention.

The width of the valleys 32 (i.e., the distance from the apex of 31 of a ridge 30 to the apex 31 of an adjacent ridge 30) may vary depending on the dimensions of the items to be stored in the container. For most whole fruits and vegetables, meats and cheeses, a distance of ½ inch or less at the widest point between the ridges is ideal. This width serves to support the food outside of the valleys 32 and, in particular, the channels 34, so gasses can flow throughout the container around the food. Very small foods or foods such as cottage cheese or yogurt that flow, of course, will not be supported on the apexes 31 of the ridges 30.

As shown in the drawings, the housing 2 further comprises a rim 40. The rim 40 extends from the tops 17 of the walls 13-16 of compartment 10 and from the tops 17 of walls 23-26 of compartment 20. The rim 40 has an uninterrupted top surface 41. The rim 40 has a peripheral rim portion 42 extending along the tops 17 of side walls 15 and 16 and end wall 13 of storage compartment 10 and along the tops 17 of side walls 25 and 26 and end wall 23 of storage compartment 20. The rim 40 also includes a bridge 44 extending along the tops 17 of end walls 14 and 24 of storage compartments 10 and 20. The bridge 44 performs several important functions, two of which are to hold the storage compartments 10 and 20 together and to make the peripheral rim portion 42 more rigid. For added strength and stability, the end walls 13 and 23 and the portions of the peripheral rim portion 42 extending across the tops 17 of walls 13 and 23 are bowed outwardly.

Figure 18:
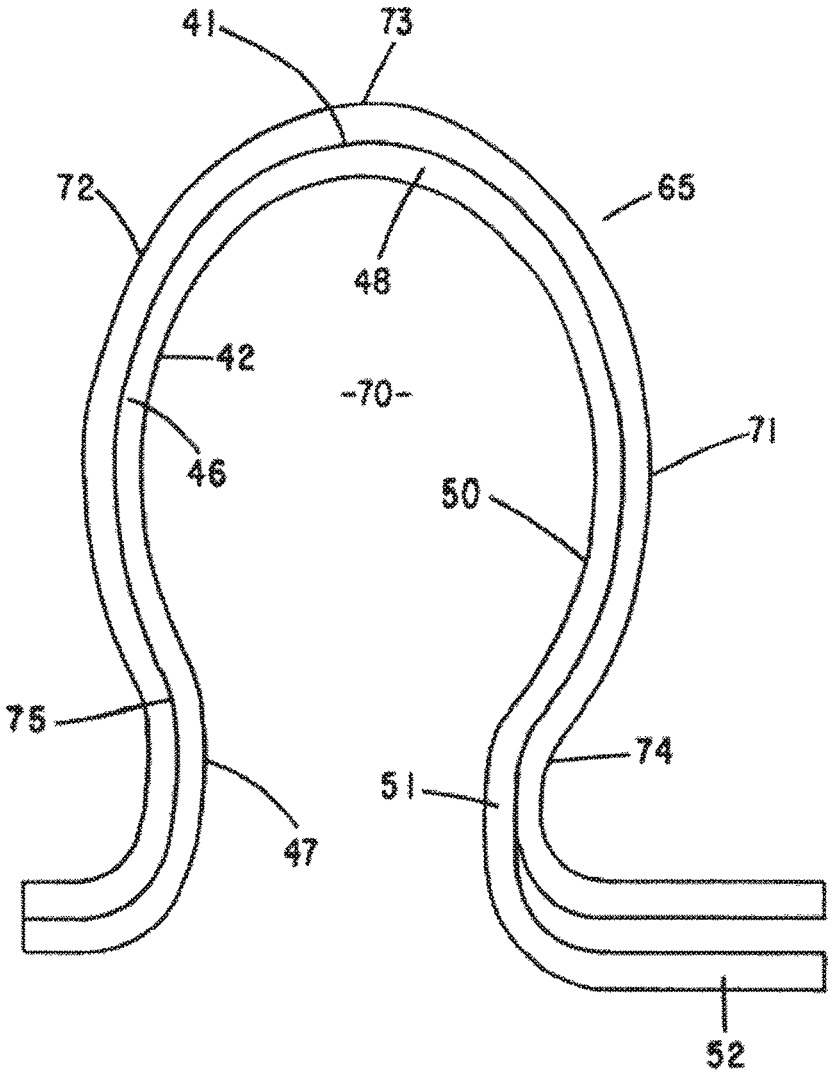
FIG. 18 is a cross-sectional view of the peripheral rim portion of the rim of the housing and the peripheral rim portion engagement section of the lid of the container of FIG. 1.
Figure 19:
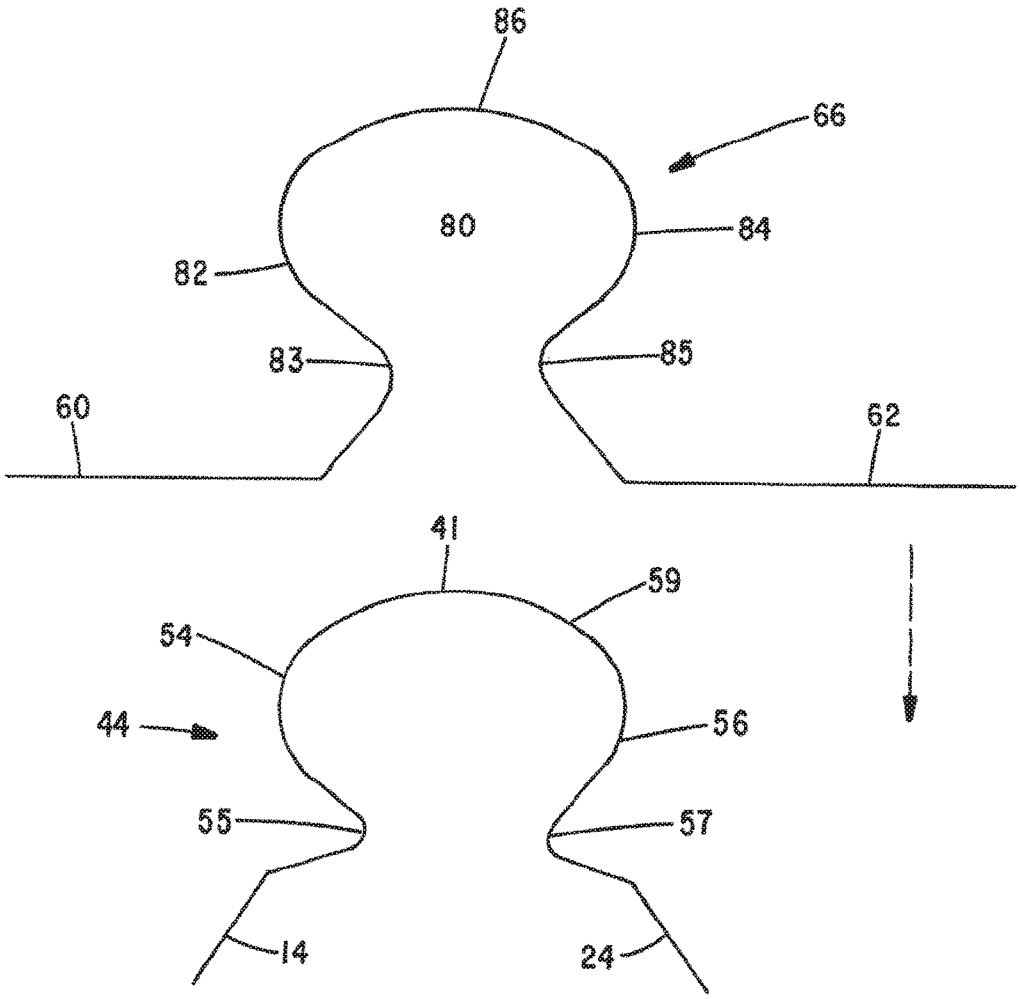
FIG. 19 is a cross sectional view of the bridge of the housing and the bridge engagement section of the lid of the container shown in FIG. 1.

The drawings, and in particular FIG. 18, show the peripheral rim portion 42 as including an upstanding interior wall 46 with a concave interior face 47, a convex head 48 extending upwardly and outwardly from the upper end of the upstanding interior wall 46, an exterior wall 50 extending downwardly from head 48 and having a concave exterior face 51, and a flange 52 projecting outwardly from the bottom of the exterior wall 50. The drawings, and in particular FIG. 19, show the bridge 44 as having a pair of bridge walls 54 and 56, each having a concave face 55, 57 facing away from each other and a convex bridge head 59 extending between upper ends of the bridge walls 54 and 56. The uninterrupted top surface 41 of rim 40 is defined by the convex head 48 of rim portion 42 and by the convex bridge head 59 of the bridge 44.

The lid 4 is shown in FIGS. 1 and 13-17. The lid 4 includes a first plate 60 and a second plate 62. More plates will be added to lid 4 if the housing 4 has more than two compartments. Only one plate will be necessary if the housing has a single storage compartment. The plates 60 and 62 are imperforate. Plate 60 is adapted to cover storage compartment 10 and plate 62 is adapted to cover storage compartment 20.

The lid 4 also includes an attachment member 64. Attachment member 64 includes a peripheral rim portion engagement section 65 and a bridge engagement section 66. The peripheral rim portion engagement section 65 has a peripheral channel 70 comprising a pair of channel walls 71 and 72 joined together by a channel head 73. The channel walls 71 and 72 have convex surfaces 74 and 75 facing each other. The channel 70 peripheral rim portion engagement section 65 is adapted to receive and form an air tight seal with the peripheral rim portion 42 of housing 2. This air tight seal serves to isolate the cavities 11 and 21 from the exterior of container 1. See, e.g., FIG. 18.

The bridge engagement section 66 joins the first and second plates 60, 62 together. Additional bridge engagement sections will be employed if more than two plates are required to cover more than two cavities of the housing. The bridge engagement section may be eliminated if the container has a single storage compartment. The bridge engagement section 66 shown in various drawings, including FIG. 19, includes a bridge receiving channel 80 comprising a pair of bridge channel walls 82, 84 joined together by a concave bridge channel head 86. The bridge channel walls 82, 84 have convex surfaces 83, 85 facing each other. The bridge receiving channel 80 of the bridge engagement section 66 is adapted to receive and form an air tight seal with the bridge 44 of housing 2. This serves to seal the two cavities 11 and 21 from each other.

The lid also includes raised foot pockets comprising platforms 110 and pockets 112. The pockets 112 are adapted to receive the feet 114 located on the bottom of the housing 2. This prevents a housing 2 from sliding relative to the lid 4 when a housing 2 is stacked on top of a lid 4 such as when a plurality of containers 1 are stacked.

The lid 4 also includes a first media (or gas source) compartment 90 and a second media (or gas source) compartment 91. Compartment 90 is recessed in plate 60 and compartment 91 is recessed in plate 62. As shown, each compartment 90, 91 includes a trough 92 defined by a lower platform 93 and an upstanding wall 94 surrounding and extending upwardly from the platform 93. The trough 92 is adapted to receive, support and contain a payload containing a reaction medium such as a gas permeable package 100 holding a source of gas, such as a gas generating medium. In the concentrations and quantities used, the gas is non-poisonous to humans and effective to kill microbes that are adept at spoiling food. Examples of such gases are provided elsewhere in this specification.

Gas flow openings 95 are also provided as a part of the media compartments 90 and 91. It is important that these gas flow openings 95 be positioned so that they are not blocked by a gas source, desiccant or other medium placed in the compartments 90/91. In the embodiments shown in the drawings, this is achieved by providing a ledge 96 extending from the top of the upstanding wall 94 of trough 92 and a peripheral wall 97 extending upwardly from the ledge 96. The gas flow openings extend from the compartment 90, 91 through either the peripheral wall 97 or the ledge 96 (or both) to the associated cavity 11, 21.

It is important that microbes or other contaminants not enter through the gas flow openings. Barriers 102 can be employed to close the open top 98 of the compartments 90, 91. These barriers can be an adhesive label that is affixed over the open top 98 to the associated plate. Such a barrier also causes any gas generated and flowing from a gas permeable package to flow through the gas flow openings and into the cavities. The gas will then kill (or at least produce a hostile environment for) the spoilage producing microbes preventing spoilage or at least substantially extending the time it takes for spoilage to occur.

While containers made in accordance with the present invention are advantageously used for the storage and transport of food items, such containers may also be used to store and transport other items susceptible to attack or infection by microbes. For example, surgical supplies that have already been sterilized may be stored in such a container so the surgical supplies do not become contaminated during storage or transport prior to use.

Such containers may also be used to store and transport items adversely affected by humid environments. In such cases, a desiccant pack may be the payload placed in the media compartment 90/91. The desiccant will draw moisture (e.g., water vapor) out of the cavities 11, 21 through the gas flow openings 95.

Also, the active substance may not be in a separate package, and the payload may contain multiple substances such as a desiccant and a gas generating substance. For these reasons, the generic terms such as "media compartments", "media", "reaction medium", or "payload" have been used to describe compartments 90/91 and what they are intended to hold.

As noted above, the number of cavities can be altered. A single cavity can be made using the invention. Likewise, additional cavities can be provided. In such cases, additional bridges are provided and the lid is modified accordingly.

Further, not all the cavities need to be provided with the ridges 30, valleys 32, and flow channels. For example, one may wish to store fruit or vegetables in a first cavity having such ridges, valleys and channels and a dip in another cavity without these features. Alternatively, items susceptible to spoilage may be stored in one or more cavities, each having ridges, valleys and channels, while other items not susceptible to spoilage are stored in cavities not having these features.

To enhance the stackability of the containers feet 114 are provided on the bottom of housing 2 and foot pockets 112 are provided in the lid 4. When the feet 114 of a housing 2 reside in the pockets 112 of the lid, the housing is inhibited from sliding relative to the lid. To provide for better circulation between stacked containers, the pockets are recessed in a raised foot pocket platform 110. This arrangement causes the base(s) of an upper container above the attachment member of the lid of a lower container in the stack.

Those skilled in the art will appreciate that still further modifications may be made without deviating from the invention.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A container comprising:

(a) a housing made as a single piece from a clear plastic polymer material, said housing having a first storage compartment having a cavity defined by an imperforate base and four imperforate walls, each of said four imperforate walls having a top and extending upwardly from the imperforate base, said four imperforate walls comprising a pair of opposing upstanding side walls, a first end wall and a second end wall, wherein each of the four imperforate walls and the imperforate base of said first storage compartment have a plurality of parallel ridges defining a plurality of concave valleys open to the cavity, wherein the plurality of parallel ridges and the plurality of concave valleys of the imperforate base and two of the imperforate walls are aligned to form a plurality of uninterrupted flow channels extending across the imperforate base and up said two of the imperforate walls, said plurality of uninterrupted flow channels being open to the cavity, said housing further comprising a rim extending from the tops of each of the imperforate four walls of said first storage compartment, said rim having an uninterrupted top surface and including a peripheral rim portion; and (b) a lid made of a single piece of clear plastic polymer material and having an imperforate plate adapted to cover the first storage compartment, an attachment member comprising a peripheral rim portion engagement section, said peripheral rim portion engagement section comprising a peripheral channel adapted to receive and form an air tight seal with the peripheral rim portion of the housing thus sealing the cavity of the first storage compartment from the exterior of the housing, said lid further comprising a media compartment having an open top and recessed in said imperforate plate, said media compartment including a trough comprising a platform and an upstanding wall surrounding the platform and extending upwardly from the platform, said platform and upstanding wall of the media compartment adapted to support and contain a payload containing a reaction medium, said media compartment including at least one gas flow opening allowing gas to flow between the media compartment and the cavity of said first storage compartment, wherein said at least one gas flow opening is positioned relative to the location of a payload placed in the trough such that the payload does not block the at least one gas flow opening, and (c) a cover for sealing and covering the open top of the media compartment.

2. The container of claim 1 further comprising a second storage compartment and a bridge, wherein the bridge joins the second storage compartment and the first storage compartment together, and wherein the uninterrupted top surface of the rim is further defined by the bridge.

3. The container of claim 2 wherein the lid has a second plate adapted to cover the second storage compartment and a bridge engagement section joining the first and second plates together and including a bridge receiving channel, wherein the bridge receiving channel is adapted to receive, and form an air tight seal with, the bridge of the housing thus sealing the cavities of the first and second storage compartments from each other.

4. The container of claim 1 wherein the media compartment further includes a ledge extending outwardly from the top of the trough and a peripheral wall extending upwardly from the ledge.

5. The container of claim 4 wherein a said at least ox a gas flow opening of the media compartment extends through the ledge of said media compartment.

6. The container of claim 4 wherein a second gas flow opening of said media compartment extends through the peripheral side wall of said media compartment.

7. The container of claim 1 wherein the first end wall and the second end wall and the portions of the rim extending from the tops of the end walls are bowed outwardly.

8. The container of claim 1 further cover for sealing the media compartment is gas impermeable.

9. The food container of claim 1 wherein the housing has a plurality of feet and the lid has a corresponding number of raised foot pockets adapted, so that when the housing is placed on the lid, the plurality of feet mate with the raised foot pockets to inhibit the housing from sliding relative to the cover and so the base of said storage compartment is above the attachment member of the lid.

10. A container comprising:

(a) a housing made as a single piece from a clear material, said housing having a first storage compartment and a second storage compartment, each of said first storage compartment and said second storage compartment having a cavity defined by base and a plurality of walls, each of said plurality of walls having a top and extending upwardly from the base, wherein the plurality of walls and the base of the first storage compartment are imperforate, wherein said plurality of walls of the first storage compartment includes a first end wall and said plurality of walls of the second storage compartment includes a second end wall, wherein the first end wall and the second end wall are adjacent each other, wherein each of the plurality of walls and the base of the first storage compartment have a plurality of parallel ridges defining a plurality of concave valleys open to the cavity the first storage compartment, wherein the plurality of parallel ridges and the plurality of concave valleys of the base and at least one of the plurality of walls defining the cavity of said first storage compartments ire aligned to form a plurality of uninterrupted flow channels extending across the base and up at least one of the plurality of imperforate walls of the first storage compartment, said plurality of uninterrupted flow channels being open to the cavity of the first storage compartment, said housing further comprising a rim extending from the tops of each of the plurality of walls of each of the first storage compartment and the second storage compartment, said rim having an uninterrupted top surface and including a peripheral rim portion and further including a bridge extending between the tops of the first and second end walls holding said first storage compartment and said second storage compartment together;

(b) a lid made of a single piece of clear plastic material and having a first imperforate plate adapted to cover the first storage compartment and a second plate adapted to cover the second storage compartment, an attachment member comprising a peripheral rim portion engagement section and a bridge engagement section, said peripheral rim portion engagement section comprising a peripheral channel adapted to receive and form an air tight seal with the peripheral rim portion of the housing thus sealing at least the cavity of the first storage compartment from the exterior of the housing, and wherein said bridge engagement section joins the first and second plates together and includes a bridge receiving channel adapted to receive and form an air tight seal with the bridge of the housing thus sealing the cavities of the first and second storage compartments from each other, said lid further comprising a first media compartment recessed in said first plate, said media compartment including a trough comprising a platform and an upstanding wall surrounding the platform and extending upwardly from the platform, said platform and upstanding wall of the first media compartment adapted to support and contain a payload comprising a reaction medium, said first media compartment including at least one gas flow opening allowing gas to flow between the first media compartment and the first storage compartment, and wherein the at least one gas flow opening is positioned relative to the location of the payload placed in the trough such that the payload does not block the at least one gas flow opening; and (c) a cover for sealing and covering the open top of the media compartment.

11. The container of claim 10 wherein at least one of the plurality of walls of each of said first storage compartment and said second storage compartment is bowed outwardly.

12. The container of claim 10 wherein the housing has second media compartment recessed in said second plate.

13. The container of claim 10 wherein the first media compartment further includes a ledge extending outwardly from the top of the trough and a peripheral wall extending upwardly from the ledge.

14. The container of claim 13 wherein a said at least one gas flow opening of the first media compartment extends through the ledge of said first media compartment.

15. The container of claim 13 wherein a second gas flow opening of the first media compartment extends through the peripheral side wall of said first media compartment.

16. The container of claim 13 wherein the first media compartment has a first gas flow opening extending through the ledge of said first media compartment and a second gas flow opening extending through the peripheral wall of said first media compartment.

17. The container of claim 10 wherein said cover for the first media compartment is gas impermeable.

18. The container of claim 10 wherein the housing has a plurality of feet and the lid has a corresponding number of raised foot pockets aligned so that when the housing is placed on the lid, the plurality of feet mate with the raised foot pockets to inhibit the housing from sliding relative to the cover and so the base of each storage compartment is above the attachment member of the lid.

19. The container of claim 10 wherein the each of the walls and base of the second storage compartment is imperforate and has a plurality of ridges defining a plurality of concave valleys open to the cavity of the second storage compartment, wherein said plurality of parallel ridges and said plurality of concave valleys of the base and at least one of the plurality of the walls defining the cavity of said second storage compartment are aligned to form a plurality of uninterrupted flow channels extending across the base and up said at least one of the plurality of the walls, said flow channels being open to the cavity of the second storage compartment.

20. The container of claim 10 wherein the lid further includes a second media compartment recessed in the second plate and having at least one as flow opening allowing gas to flow between the second media compartment and the cavity of the second storage compartment.

* * * * *